US012653297B2

(12) United States Patent
Choi

(10) Patent No.: US 12,653,297 B2
(45) Date of Patent: Jun. 16, 2026

(54) COSMETIC CASE

(71) Applicant: TAEYANG RENEW Inc., Seoul (KR)

(72) Inventor: Man Soo Choi, Incheon (KR)

(73) Assignee: TAEYANG RENEW INC., Seoul (KR)

( * ) Notice: Subject to any disclaimer, the term of this patent is extended or adjusted under 35 U.S.C. 154(b) by 223 days.

(21) Appl. No.: 18/474,224

(22) Filed: Sep. 26, 2023

(65) Prior Publication Data

US 2024/0115031 A1 Apr. 11, 2024

(30) Foreign Application Priority Data

Oct. 6, 2022 (KR) ..... 10-2022-0127825
Sep. 22, 2023 (KR) ..... 10-2023-0126825

(51) Int. Cl.
*A45D 34/04* (2006.01)
*A46B 11/00* (2006.01)

(52) U.S. Cl.
CPC ..... *A45D 34/045* (2013.01); *A45D 34/042* (2013.01); *A45D 34/043* (2013.01); *A45D 2200/054* (2013.01); *A45D 2200/10* (2013.01); *A46B 11/0079* (2013.01); *A46B 11/0089* (2013.01)

(58) Field of Classification Search
CPC ..... A45D 34/045; A45D 2200/054; A45D 2200/10; A45D 34/042; A45D 34/043; A45D 40/262; A45D 40/264; A46B 11/001; A46B 1/002; A46B 11/0079; A46B 11/0089
USPC ..... 401/102, 109, 272, 290
See application file for complete search history.

(56) References Cited

U.S. PATENT DOCUMENTS

| | | | | |
|---|---|---|---|---|
| 3,359,992 A * | 12/1967 | Cishek | A45D 40/264 401/101 |
| 4,687,364 A | 8/1987 | Kingsford | |
| 5,102,250 A | 4/1992 | Gueret | |
| 5,397,195 A * | 3/1995 | Goncalves | A45D 34/043 401/116 |
| 6,056,470 A | 5/2000 | Nehashi et al. | |
| 6,616,366 B1 | 9/2003 | Weihrauch | |
| 7,182,535 B2 | 2/2007 | Lim | |
| 8,215,858 B2 * | 7/2012 | Carroll | A45D 34/043 401/176 |

(Continued)

FOREIGN PATENT DOCUMENTS

| | | |
|---|---|---|
| CN | 105077964 A | 11/2015 |
| JP | S61-194407 U | 12/1986 |

(Continued)

OTHER PUBLICATIONS

International Search Report for International Patent Application No. PCT/KR2024/017394 issued by the International Searching Authority on May 9, 2025.

(Continued)

*Primary Examiner* — David J Walczak
(74) *Attorney, Agent, or Firm* — IP & T GROUP LLP

(57) ABSTRACT

A cosmetic case that keeps a cosmetic in a standby state by automatically filing an application portion with a cosmetic so that a user may use it at any time, is hygienic by separating a cosmetic and a space where an application case is provided, and by blocking contact between a cosmetic and external air, which allows for efficient use of a cosmetic.

13 Claims, 14 Drawing Sheets

(56) References Cited

U.S. PATENT DOCUMENTS

| | | | |
|---|---|---|---|
| 9,642,438 | B2 | 5/2017 | Choi |
| 2005/0092345 | A1 | 5/2005 | Lim |
| 2006/0249171 | A1 | 11/2006 | Kurek et al. |
| 2024/0115031 | A1 | 4/2024 | Choi |

FOREIGN PATENT DOCUMENTS

| | | | |
|---|---|---|---|
| JP | 62-79010 | A | 4/1987 |
| JP | H01-156778 | U | 10/1989 |
| JP | H11-206453 | A | 8/1999 |
| JP | 2003-170974 | A | 6/2003 |
| JP | 2005-137874 | A | 6/2005 |
| JP | 2017-516617 | A | 6/2017 |
| JP | 3245204 | U | 1/2024 |
| KR | 20-0239139 | Y1 | 9/2001 |
| KR | 10-2002-0095018 | A | 12/2002 |
| KR | 10-2008-0024942 | A | 3/2008 |
| KR | 20-2010-0000469 | U | 1/2010 |
| KR | 10-0995077 | B1 | 11/2010 |
| KR | 10-2016-0027331 | A | 3/2016 |
| KR | 10-1671419 | B1 | 11/2016 |
| KR | 10-1806051 | B1 | 1/2018 |
| KR | 10-2018-0101096 | A | 9/2018 |
| KR | 10-2024-0048477 | A | 4/2024 |
| WO | 2008/069354 | A1 | 6/2008 |
| WO | 2008/102992 | A1 | 8/2008 |
| WO | 2020/017150 | A1 | 1/2020 |

OTHER PUBLICATIONS

Office Action for Japanese Patent Application No. 2024-157205 issued by the Japanese Patent Office on Aug. 12, 2025.

Office Action for Korean Patent Application No. 10-2024-0110377 issued by the Korean Patent Office on Oct. 21, 2025.

Notice of Allowance for Korean Patent Application No. 10-2023-0126825 issued by the Korean Intellectual Property Office on Dec. 18, 2024.

Notice of Allowance for Japanese Patent Application No. 2024-157205 issued by the Japanese Patent Office on Feb. 3, 2026.

Office Action for Chinese Patent Application No. 202311229172.1 issued by the Chinese Patent Office on Apr. 28, 2026.

* cited by examiner

COSMETIC CASE

CROSS-REFERENCE TO RELATED PATENT APPLICATION

The present application claims priority under 35 U.S.C. § 119 (a) to Korean patent application number 10-2022-0127825 filed on Oct. 6, 2022, in the Korean Intellectual Property Office, the entire disclosure of which is incorporated by reference herein.

BACKGROUND OF THE INVENTION

1. Field

The present disclosure relates to a cosmetic case.

2. Description of the Related Art

Mascara, a cosmetic that is applied to eyelashes to make eyelashes look thick and long, is used by applying cosmetic to an application portion. Generally, a cosmetic is stored in a cosmetic case, and a mascara application portion is dipped in a cosmetic, and a cosmetic applied to an application portion is applied to eyelashes.

For many mascaras, a lid of a cosmetic case becomes a handle that a user grips, and an application portion extending from a handle is accommodated in a space containing a cosmetic when a lid is coupled to a case and closed.

However, when an application portion is accommodated in a space containing a cosmetic, there is a problem that, as a cosmetic is repeatedly applied to an application portion and then dropped off therefrom, a cosmetic liquid deteriorates early due to contact with air and mascara may not be used effectively.

SUMMARY OF THE INVENTION

The object of the present invention is to provide a cosmetic case which prevents an application portion from being dried by automatically filling an application portion with a certain amount of cosmetic, which is hygienic by separating spaces where a cosmetic and an application portion are prepared and by blocking contact with external air, and which allows to use a cosmetic efficiently.

A cosmetic case according to an embodiment of the present invention comprises: an application portion for delivering a cosmetic to a place of use; a main body having an accommodation space for accommodating the application portion and a storage space for storing a cosmetic; a guide portion provided inside the main body to form a double tube with the main body to form the storage space; a brush having one end fixed to the application portion and the other end provided to be movable within the guide portion; and a lid portion for sealing an outside of the accommodation space and introducing the application portion to the accommodation space, wherein the guide portion provides a compression space storing a cosmetic on one side facing the brush and compressing the same by the other end of the brush, and wherein the brush has a hollow tube shape and may be provided with a discharge port at one end toward the application portion and with a recovery port toward inside of the guide portion.

Specifically, when the application portion is introduced by the lid portion, as the compression space is compressed by the brush, a cosmetic positioned in the compression space is delivered to the accommodation space along an inside of the brush, and at least a part of a cosmetic flowing inside the brush may be received to the guide portion through the recovery port.

Specifically, a cosmetic case according to an embodiment of the present invention further comprises: a delivery portion for delivering a force of a first spring provided on a lower surface of the guide portion to enable movement of the brush; a support portion for supporting the brush to form the accommodation space; a connection portion for connecting the application portion and the brush; a sealing portion for sealing an inside of the brush; and a third spring provided between the connection portion and the sealing portion, wherein the sealing portion, when a cosmetic is delivered from an inside of the brush to the accommodation space, may contact with the connection portion by compression of the third spring to enable delivery of a cosmetic and may block delivery of a cosmetic in direction from the accommodation space to an inside of the brush.

Specifically, the lid portion surrounds a part of the application portion to limit movement of the application portion, and the application portion absorbs within an acceptable limit a cosmetic delivered to the accommodation space according to compression of the compression space so that a cosmetic may be delivered within the acceptable limit regardless of an amount of cosmetic used by a user.

A cosmetic case according to an embodiment of the present invention comprises: an application portion for delivering a cosmetic to a place of use; a main body having an accommodation space for accommodating the application portion and a storage space for storing a cosmetic; a guide portion provided inside the main body to form the storage space; a brush having one end fixed to the application portion and the other end provided to be movable within the guide portion; a support portion for supporting the brush and distinguishing the accommodation space and the storage space; and an expansion portion in which thickness of a specific section of the brush becomes thicker, wherein a movement speed when the expansion portion passes the support portion may be slower than a movement speed when another section of the brush passes the support portion.

Specifically, the expansion portion is provided, in addition to the specific section, above a delivery portion for delivering a force of a first spring provided on the guide portion to enable movement of the brush, wherein the expansion portion provided above the delivery portion may be engaged with the support portion at a maximum movement distance of the brush to prevent leakage of a cosmetic stored in the storage space.

A cosmetic case according to an embodiment of the present invention comprises: a main body comprising a first body, a second body, and a first coupling portion; an application portion for using a cosmetic stored in the main body; and a lid portion coupled to the first coupling portion, the lid portion comprising: a movable lid contacting with the application portion to move inside the lid portion; a fixed lid fixed to one end of the lid portion; a second coupling portion coupled to the first coupling portion; and a protective sleeve provided inside the second coupling portion to move together with the movable lid, wherein in coupling of the lid portion and the main body, the movable lid contacts with the second body and the application portion to move in a direction where the fixed lid is prepared, and the protective sleeve which moves together with the movable lid eventually exposes the second coupling portion so that the second coupling portion and the first coupling portion are coupled to fix.

Specifically, the protective sleeve protects the second coupling portion so that a cosmetic discharged through the application portion may not reach the second coupling portion, and the movable lid is moved by a second spring provided on the fixed lid, and when no pressure is applied to the second spring, is disposed immediately before a position where the second coupling portion is provided so that the protective sleeve may protect the second coupling portion.

Specifically, a cosmetic case according to an embodiment of the present invention comprises: a guide portion engaged in an inside of the first body to form a double tube and be fixed; a brush having one end at which the application portion is provided and the other end engaged with the guide portion to form a compression space and slide; and a support portion provided inside the first coupling portion to support the brush, wherein the brush has a specific section in a longitudinal direction that is provided to be thicker than the thickness of other sections, and when the main body and the lid portion are separated, a sliding speed of the brush is different according to the thickness of the specific section so that a speed of the application portion protruding from the second body may be different.

Specifically, the support portion is made of an elastic material to support the brush despite a thickness difference of the brush, and the brush comprises a delivery portion that is distinguished by a step from the other sections in the specific section or has a thickness that gradually changes to form a linear shape and that is provided in a direction perpendicular to the longitudinal direction, wherein the delivery portion may be engaged with the guide portion to support sliding of the brush and limit a sliding length of the brush, enable the cosmetic to move within the guide portion in a dislocated shape, and deliver an elastic force of a first spring provided on the guide portion to the brush.

Specifically, a cosmetic case according to an embodiment of the present invention comprises a connection portion for connecting the application portion and the brush, wherein the connection portion is partially open in comparison with a cross-section in a direction perpendicular to the longitudinal direction of the brush to deliver the cosmetic provided in the brush, and the brush may be introduced when the main body and the lid portion are coupled to enable a cosmetic provided in the compression space to move into the brush.

Specifically, a cosmetic case according to an embodiment of the present invention further comprises a sealing portion for sealing an inside of the brush; and a third spring provided between the connection portion and the sealing portion, wherein the sealing portion, when a cosmetic is delivered from an inside of the brush to an accommodation space accommodating the application portion, may contact with the connection portion by compression of the third spring to enable delivery of a cosmetic and may block delivery of a cosmetic in a direction from the accommodation space to an inside of the brush.

Specifically, a cosmetic case according to an embodiment of the present invention further comprises a discharge portion, which, when the main body and the guide portion are assembled, discharges air filled inside the guide portion so that the cosmetic stored in the main body passes through the support portion to move to the guide portion.

The cosmetic case according to the present invention can keep a cosmetic in a standby state by automatically filling an application portion with a cosmetic so that a user may use at any time, is hygienic by separating a cosmetic and a space where an application case is provided and by blocking a contact between a cosmetic and external air, and allows for efficient use of a cosmetic.

Effects of the present invention are not limited to the above-mentioned effects, and effects that are not mentioned will be clearly understood by those skilled in the art from this specification and the accompanying drawings.

DETAILED DESCRIPTION

This specification clarifies the scope of the present invention, explains the principles of the present invention, and discloses embodiments so that those skilled in the art may practice the present invention. The disclosed embodiments may be implemented in various forms.

Throughout this specification, when a part is said to be "connected" to another part, this includes not only a case of being directly connected but also a case of being indirectly connected, and indirect connection includes being connected through a wireless communication network.

In addition, terms used in this specification are used to describe embodiments, and are not intended to restrict and/or limit the disclosed invention. Singular expressions include plural expressions unless the context clearly dictates otherwise. In this specification, terms such as "comprise" or "have" are intended to indicate that there exists a feature, number, step, operation, component, part, or a combination thereof described in the specification, but do not exclude in advance the existence or the possibility of adding one or more other features, numbers, steps, operations, components, parts, or combinations thereof.

In addition, terms including ordinal numbers such as "first" and "second" used herein may be used to describe various components, but the components are not limited by the terms, and the terms are used only for the purpose of distinguishing one component from another. For example, a first element may be named as a second element, and similarly, a second element may also be named as a first element without departing from the scope of the present invention.

In addition, terms such as "~ portion," "~ group," "~ block," "~ member," and "~ module" may mean a unit that processes at least one function or operation.

Figure 1:
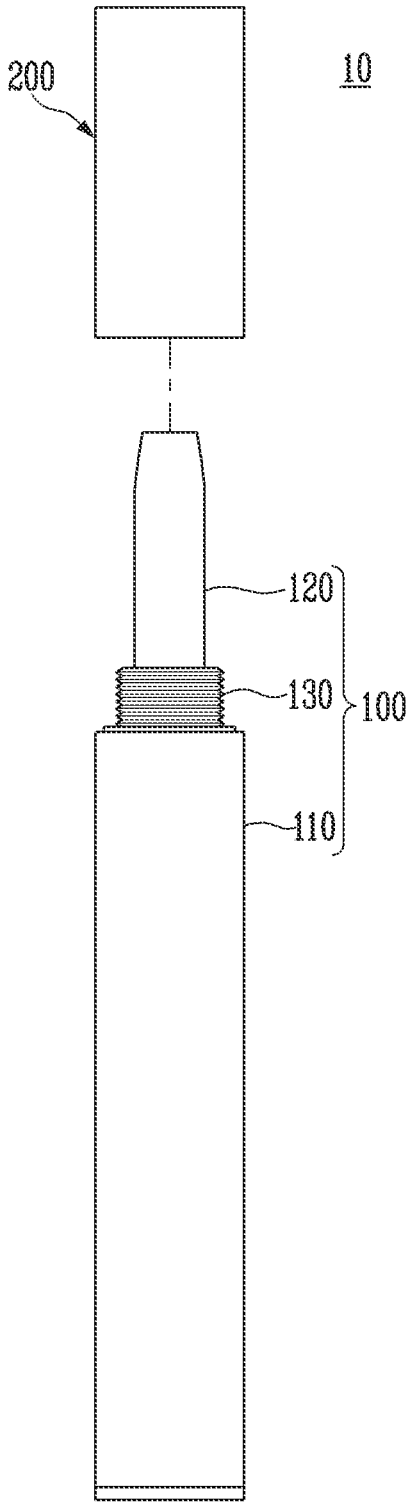
FIG. 1 is diagram illustrating an overall appearance of a cosmetic case according to one embodiment of the present invention.
Figure 2:
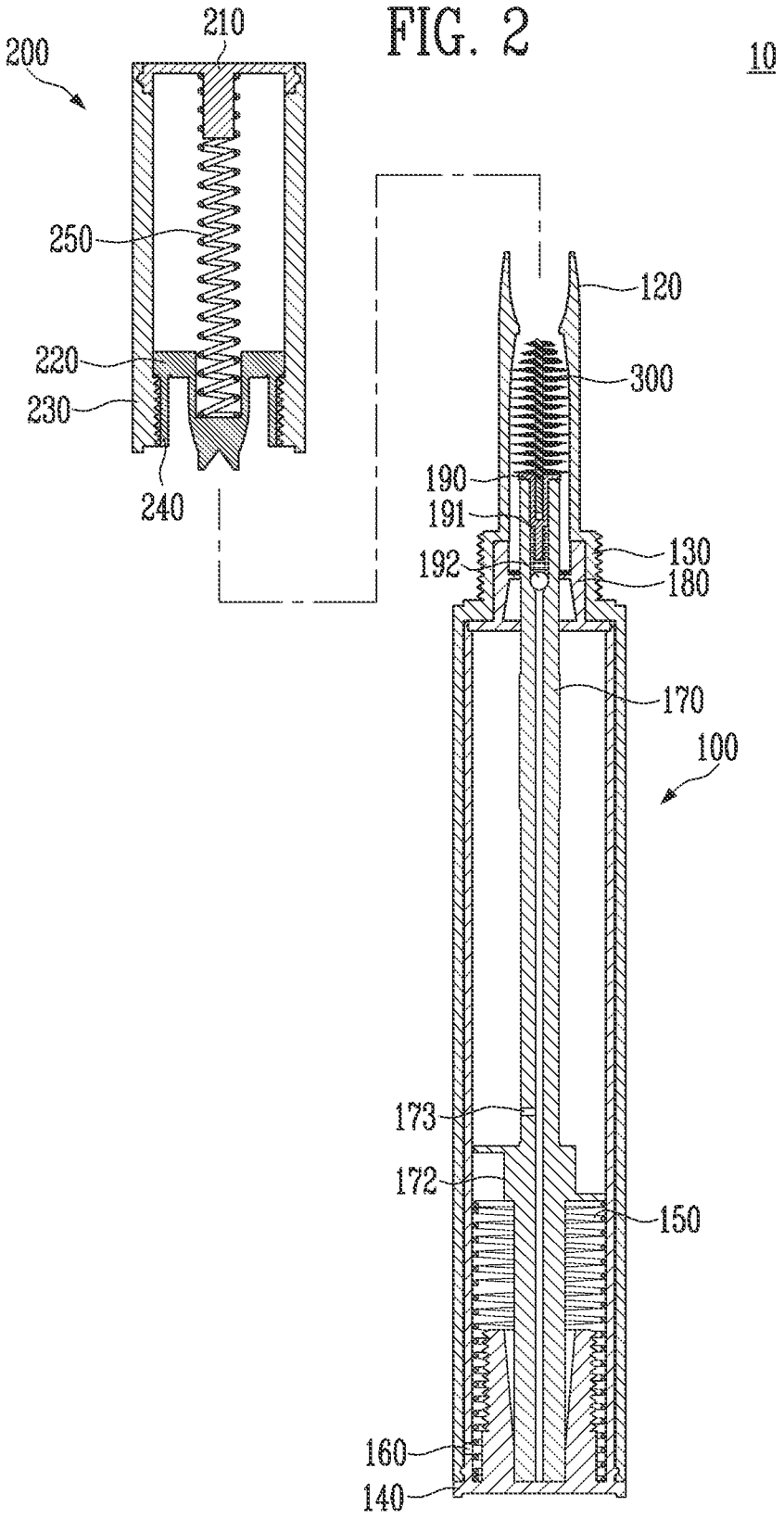
FIG. 2 is a cross-sectional diagram of a cosmetic case according to one embodiment of the present invention.

FIG. 1 is diagram illustrating an overall appearance of a cosmetic case according to one embodiment of the present invention, and FIG. 2 is a cross-sectional diagram of a cosmetic case according to one embodiment of the present invention.

As illustrated in FIGS. 1 and 2, a cosmetic case 10 according to one embodiment of the present invention may comprise a lid portion 200 and a main body 100.

Specifically, the lid portion 200 may be coupled to the main body 100 and may comprise a fixed lid 210, a movable lid 220, a second coupling portion 230, a protective sleeve 240, and a second spring 250.

A fixed lid 210 is fixed to one end of the lid portion 200, and one side may be provided as a flat surface and the opposite side may have a protruding shape. A flat surface of a fixed lid 210 may form the outer surface of a lid portion 200, and a protruding shape of a fixed lid 210 may be provided inside a lid portion 200 to hold a second spring 250.

A fixed lid 210 may be fixed by being engaged with a groove provided in a lid portion 200, and may be made of a material to withstand pressure due to compression of a second spring 250 provided between a fixed lid 210 and a movable lid 220. A flat surface of a fixed lid 210 may be provided as a mirror or the like that can reflect objects on an outer surface of a lid portion 200 so that a user's eyelashes or the like may be checked.

A movable lid 220 may be provided inside a lid portion 200 and may move in contact with an application portion 300 or a second body 120 provided on a main body 100. In a movable lid 220, a part that is in contact with an application portion 300 may be provided in a shape having a concave central portion and a protruding peripheral portion to cover a part of an application portion 300 and may be provided to be protruding compared to a part contacting with a second body 120.

A movable lid 220 may be pushed outward away from a fixed lid 210 by a second spring 250, and a shape protruding from a movable lid 220 may cover a part of an application portion 300 and come into contact with the same. In a shape protruding from a movable lid 220, a part in contact an application portion 300 may be provided in to be concave, and a peripheral part may be provided to be relatively convex to accurately contact an application portion 300.

Through double sealing in which a movable lid 220 contacts a second body 120 to seal the same and a shape protruding from a movable lid 220 contacts an application portion 300 to seal the same, a cosmetic may be prevented from being leaked to an outside of an accommodation space in which an application portion 300 is accommodated.

Since a movable lid 220 may move in contact with an application portion 300, it may be made of a material having elasticity to prevent damage to an application portion 300.

A second spring 250 is provided between a movable lid 220 and a fixed lid 210 to move a movable lid 220 inside a lid portion 200, and since a movable lid 220 moves in contact with an inside of a lid portion 200, it may prevent a cosmetic from penetrating from a main body into a lid portion 200.

When a lid portion 200 and a main body 100 are coupled, a second spring 250 may be compressed so that a movable lid 220 may come into contact with a fixed lid 210 to prevent a cosmetic from penetrating between with a fixed lid 210 and a movable lid 220.

A second coupling portion 230 may be provided in a lid portion 200 in a direction in which a movable lid 220 protrudes or in a direction of a second body 120 to be coupled with a first coupling portion 130 of a main body. Referring to FIG. 2, a first coupling portion 130 a second coupling portion 230 are illustrated as spiral lines, but this is only an example and may comprise a known feature that may be coupled to each other such as a magnet.

A part that protrudes from a movable lid 220 and contacts with an application portion 300 may be provided to protrude or not protrude from a lid portion 200 when a second spring 250 is relaxed, and a vertical part coupled with a second coupling portion 230 in a movable lid may guide a lid portion 200 and a main body to be easily coupled.

A second coupling portion 230 may be coupled to a first coupling portion 130 to fix a lid portion 200 and a main body 100, and coupling of a second coupling portion 230 and a first coupling portion 130 may have a coupling force that can withstand an elastic force generated by compression of a second spring 250 provided on a fixed lid 210 and a first spring 150 provided on a guide portion 140.

For example, when a second coupling portion 230 and a first coupling portion 130 are screwed together, a locking structure (not shown) may be provided in a screw coupling, and when coupling is completed, a clicking sound or a tactile sensation with a feeling of being caught is generated so that a user can recognize that a lid portion 200 and a main body 100 are completely coupled.

A protective sleeve 240 may be provided inside a second coupling portion 230 to move together with a movable lid 220 and may be connected to a movable lid 220 in some cases. When a lid portion 200 and a main body 100 are separated, a protective sleeve 240 may be disposed inside a second coupling portion 230 to prevent a cosmetic in a main body 100 from moving to a second coupling portion 230.

Unlike conventional cosmetic cases, a cosmetic case 10 according to one embodiment of the present invention is provided with a protective sleeve 240 for preventing a cosmetic from moving to a second coupling portion 230 to solve hygienic or aesthetic problems that are caused by a cosmetic that remains or that is hardened in a coupling portion.

When a lid portion 200 and a main body 100 are coupled, a protective sleeve 240 may move in the direction of a fixed lid 210 together with a moving lid 220 and eventually expose a second coupling portion 230 so that a first coupling portion 130 and a second coupling portion 230 may be coupled.

A second spring 250 may be provided in a protruding shape of a fixed lid 210 and may connect a fixed lid 210 and a movable lid 220. When a lid portion 200 and a main body 100 are coupled, a second spring 250 may be compressed by receiving pressure, and when a lid portion 200 and a main body 100 are separated, it may be elongated to dispose a movable lid 220 immediately before a position where a second coupling portion 230 is provided and may be replaced by a known configuration, rather than a spring, that has a restoring force for being compressed and then restored again.

Specifically, a main body 100 may comprise a first body 110, a second body 120, and a first coupling portion 130.

A first body 110 forms most of a main body 100, and a user may use an application portion 300 protruding from a body 100 while holding the same as a handle. A first body 110 may have various shapes such as a cylinder or a polygonal column and may have a shape of which a part is transparent to know a remaining amount of cosmetic in a first body 110.

A second body 120 is connected to a first coupling portion 130 and may have a diameter smaller than that of a first coupling portion 130. It is provided in a form protruding from a first coupling portion 130, and an end part is formed in an oblique line, and when a lid portion 200 and a main body 100 are separated, an application portion 300 protrudes from a second body 120 to be used by a user.

In a part where an application portion 300 of a second body 120 protrudes, that is, a part in contact with a movable lid 220, an inside and an outside are formed, not in a straight line, but in a curvature or oblique line, so that some sections are narrowed or they may be provided in a vertical form, but are not limited thereto.

In a second body 120, an inside is provided in a shape that is narrowed to hold a brush 170 for moving an application portion 300 to prevent shaking, to move a cosmetic discharged from an application portion 300 protruding from an inlet of a second body 120 in a direction of a first body 110 again, and to filter impurities that may be attached to an application portion 300, such as eyelashes, at a shape that is narrowed in an inside.

A first coupling portion 130 may connect between a first body 110 and a second body 120 to be coupled to a second coupling portion 230 of the lid portion 200. A first coupling portion 130 may be provided to have a diameter that is larger than that of a second body 120 and a diameter that is smaller than that of a first body 110 to be provided in a stair form.

Specifically, an inside of a main body 100 may comprise a guide portion 140, a first spring 150, a discharge portion 160, a brush 170, a support portion 180, a connection portion 190, and an application portion 300.

A guide portion 140 may be engaged with an inside of a first body 110 to form a double tube and be fixed and may have a plurality of protruding shapes. A cosmetic may be stored inside a guide portion 140 inside a main body 100, and a compression space 174, which is a space compressed by the other end of a brush 170 in the guide portion 140, may be provided.

When a brush 170 slides or moves to protrude an application portion 300 from a second body 120, a problem may occur that a cosmetic stored in a guide portion 140 moves together so a cosmetics is leaked out of a main body 100, and this problem may be prevented by a brush 170 and a support portion 180 for supporting a brush 170.

A support portion 180, which will be described later, is made of an elastic material and is provided to come into contact with a circumference of a brush 170 to support sliding of a brush 170 and prevent a cosmetic from leaking beyond a support portion 180. A cosmetic stored in a guide portion 140 is stored in a space closed by a guide portion 140, a brush 170, and a support portion 180, except for an inside of a brush 170, which will be described later, to prevent leakage.

A plurality of protruding shapes from a guide portion 140 may be a position where a first spring 150 is provided as well as a space in which the other end of a brush 170 is engaged, and may have grooves or curves on one side to fix a part of a first spring 150.

A first spring 150 may be provided with a part fixed at a plurality of protruding shapes from a guide portion 140 and may come into contact with a brush 170, specifically a delivery portion 172 of a brush 170 to be compressed or elongated.

When a lid portion 200 and a main body 100 are coupled, a first spring 150 receives pressure and is compressed like a second spring 250, and when a lid portion 200 and a main body 100 are separated, a first spring 150 is elongated to push away a brush 170 through a delivery portion 172 so that an application portion 300 provided at one end of a brush 170 may protrude from a second body 120 to be used by a user.

Referring to FIG. 2, a first spring 150 may come into contact with a delivery portion 172 provided in a direction perpendicular to a longitudinal direction of a brush 170 to deliver a force may be supported by a delivery portion 172 so that a brush 172 may slide inside a main body 100 without being twisted, and at least one first spring 150 may be provided at a plurality of protruding shapes from a guide portion 140.

A first spring 150 may be provided to have a diameter that is larger than that of a second spring 250. A first spring 150 may be replaced by a known configuration, rather than a spring, that has a restoring force for being compressed and then restored again.

A discharge portion 160 is a hole provided on one side of the guide portion 140 and may discharge air inside a discharge portion 160 to an outside. Therefore, when a guide portion 140 is assembled with a main body 100 provided with a cosmetic, air inside a guide portion 140 may be discharged, and after a guide portion 140 and a main body 100 are assembled, a discharge portion 160 may be blocked by a main body 100 to prevent a cosmetic provided in a guide portion 140 from being leaked.

Assembly of a guide portion 140 and a main body 100 will be described in detail with reference to FIG. 7 that will be described later.

The other end of a brush 170 is engaged with a guide portion 140, and an application portion 300 may be provided at one end and may move by sliding inside a main body 100. Specifically, it may move by sliding inside a guide portion 140 provided on a main body 100, and a driving force for sliding movement may be an elastic force of a plurality of first springs 150 provided on a guide portion 140.

The length of a brush 170 may be provided to be longer than a length of a first body 110 so that an application portion 300 provided at one end may protrude from a second body 120 when a lid portion 200 and a main body 100 are separated.

A brush 170 comprises an outlet (no reference numeral shown), which is a space in which a connection portion 190 that will be described later is mounted, at one end where a delivery portion 172 provided in a direction perpendicular to a longitudinal direction and an application portion 300 are coupled, and an outlet and a discharge portion 160 are different from each other.

A brush 170 has a cylindrical cross-section in the form of a hollow tube, and an inside is empty so that a cosmetic may be delivered to an application portion 300 through an outlet through an inside of a brush 170.

At one end of a brush 170, an application portion 300 and a connection portion 190 surrounding an application portion 300 may be provided. A third spring 191 may be mounted at a lower end of a connection portion 190, and a third spring 191 may compress to move a sealing portion 192 for sealing an inside of a brush 190. The connection portion will be described later, and a third spring 191 and a sealing portion 192 will be described in detail in FIGS. 4A, 4B, and 4C.

Referring to FIG. 2, a delivery portion 172 of a brush 170 may be provided around a brush 170 in a form in which semicircles are coupled to each other to be offset from each other. A delivery portion 172 of a brush 170 may come into contact with a guide portion 140 to support sliding of a brush 170, limit a sliding length of a brush 170, and deliver an elastic force of a first spring 150 provided on a guide portion 140 to a brush 170.

Delivery portions 172 of a brush 170 may be coupled to be offset from each other so that a cosmetic may move between delivery portions 172 of a brush 170 within a guide portion 140, and when a brush 170 slides so that an application portion 300 may protrude, pressure of a cosmetic between a support portion 180 and a delivery portion 172 may increase within a guide portion 140, and a cosmetic with an increased pressure may pass through a delivery portion 172 of a brush 170 to move toward a first spring 150 or a compression space 174.

A thickness of a brush 170 may vary for each section in a longitudinal direction, and a brush 170 may comprise an expansion portion 171 in which a thickness of a specific section is thicker than that of other sections.

When a lid portion 200 and a main body 100 are separated, a brush 170 slides so that an application portion 300 provided at one end of a brush 170 protrudes from a second body 120, and a protruding speed may vary depending on a thickness difference between an expansion portion 171 of a brush 171 and other section. Details will be described later with reference to FIGS. 4A, 4B and 4C.

A brush 170 may comprise a recovery port 173 for connecting an inside with a guide portion 140. A recovery port 173 may be provided on at least one surface of a brush 170 to recover to a guide portion at least a portion of a cosmetic moving inside a brush 170. Details will be described later with reference to FIGS. 4A, 4B and 4C.

At the other end of a brush 170, configurations corresponding to a third spring 191 and a sealing portion 192 provided at one end of a brush 170 may be provided. Although not shown, a fourth spring corresponding to a third spring 191, a closing portion corresponding to a sealing portion 192, and a holder on which a closing portion is mounted may be provided at the other end of a brush 170, but position of each configuration is not limited and it may be disposed at another position within a cosmetic case 10.

A holder may be provided separately from a brush 170 to be fixed to the other end of the brush 170 by fitting, and a fourth spring may be provided to have a diameter that is than an inner diameter of a brush 170. A closing portion may be opened and closed by pressure of a cosmetic provided between a fourth spring and a closing portion and delivered from a compression space 174.

When an application portion 300 is introduced by a lid portion 200, an compression space 174 is compressed by a brush 170, and a cosmetic located in a compression space 174 moves into a brush 170, and a fourth spring is compressed and a closing portion is raised by pressure of a cosmetic at that time so that a cosmetic may move into a brush 170 to be delivered to an accommodation space.

Since movement of a cosmetic from an inside of a brush 170 to a compression space 174 may be prevented by a closing portion, a third spring 191 provided at a lower end of a connection portion 190 and a sealing portion 192 may prevent an inflow of external air so that a content or a cosmetic may be kept in a vacuum state. A support portion 180 may be provided inside a first coupling portion 130 to support a brush 170, come into contact with a brush 170 to prevent a cosmetic from flowing out beyond a support portion 180, and form an accommodation space (no reference numeral shown) in which an application portion 300 is accommodated. A support portion 180 may be made of an elastic material, and for example, a material such as PE may be used.

A support portion 180 may comprise a portion provided inside a first coupling portion 130, a protruding point 181 that protrudes, and a surface forming an accommodation space, and a protruding point 181 may come into contact with a brush 170.

A protruding point 181 in a support portion 180 may also be made of an elastic material to bend in a direction in which a brush 170 slides, or it may be provided without spacing for having a same diameter as an expansion portion 171 so that an accommodation space for accommodating a cosmetic not to be leaked beyond a guide portion 140 may be distinguished from a storage space for storing a cosmetic.

Above or below a protruding point 181 in a support portion 180, a sealing ring may be provided to ensure separation between an accommodation space and a compression space and to seal an accommodation space. A sealing ring may have a circular cross-section and may be provided above or below a protruding point 181 to isolate a content or a cosmetic from external air so that a content may be provided in a vacuum state, and may keep a cosmetic in a vacuum state dually together with a support portion 180.

A connection portion 190 may be provided at one end of a brush 170 and may play a role of connecting an application portion 300 and a brush 170. A connection portion 190 may have a cylindrical shape to comprise a pillar of an application portion 300, but is different from a cross-section of a brush 170 so that a cosmetic provided inside a brush 170 may be delivered to an application portion 300. Details will be described later in FIG. 6.

A third spring 191 may be mounted on a lower end of a connection portion 190, and a third spring 191 may compress to move a sealing portion 192 for sealing an inside of a brush 170. A third spring 191 and a sealing portion 192 will be described in detail later in FIGS. 4A, 4B and 4C.

An application portion 300 may be provided at one end of a brush 170 and may play a role of applying a cosmetic to a place of use or eyelashes of a user. A material and a shape of an application portion 300 may vary, and when a lid portion 200 and a main body 100 are coupled, it is provided inside a second body 120, that is, in an accommodation space, and then when a lid portion 200 for sealing an outside of an accommodation and a main body 100 are separated, it may protrude from a second body 120 by sliding of a brush 170 to be externally exposed.

Although an application portion 300 is provided in a size that comes into contact with an accommodation space, but it may be provided to be larger than a shape that is narrowed inside a second body 120, and the purpose is, through a process in which a tip of an application portion 300 is pressed in a shape that is narrowed inside a second body 120, to allow an appropriate amount to be applied onto an outer surface of an application portion 300 so that a user may perform makeup easily.

An application portion 300 may be provided on a main body 100 and may come into contact with a movable lid 220 in a lid portion 200, and thus is different from a shape in which an application portion is provided at an existing lid portion and a cosmetic is contained in an existing main body.

Conventionally, makeup was performed with an application portion provided at a lid portion, and when a cosmetics was insufficient, makeup was performed by dipping in a cosmetic in an existing main body. Therefore, there was an inconvenience that an application portion provided at a lid portion should be dipped in a cosmetic several times to finish makeup. In addition, there was a problem that repeated use of an application portion applied to eyelashes at a main body of a cosmetic causes deterioration of a cosmetic liquid, resulting in deterioration of hygiene or product quality.

In contrast, a cosmetic case 10 according to an embodiment of the present invention provides a cosmetic and an application portion 300 in a main body 100 and continuously supplies a cosmetic to an application portion 300 through an inside of a brush 170 to improve an existing problem.

Figure 3:
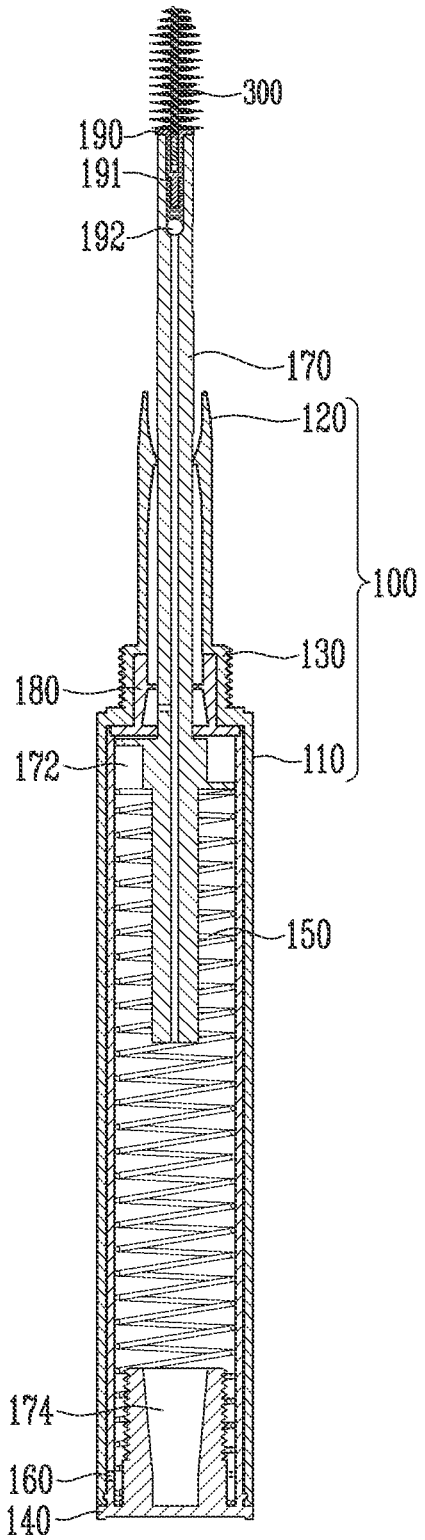
FIG. 3 is a cross-sectional diagram of a state of an application portion protruding from a cosmetic case according to one embodiment of the present invention.
Figure 4A:
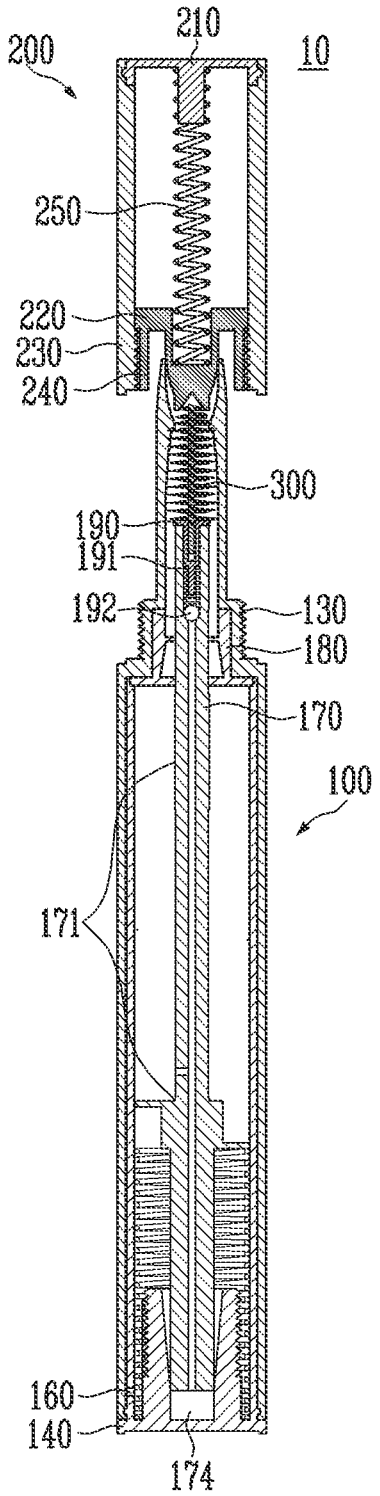
FIG. 4A is a cross-sectional diagram of a process of coupling a lid portion and a main body in a cosmetic case according to one embodiment of the present invention.
Figure 4B:
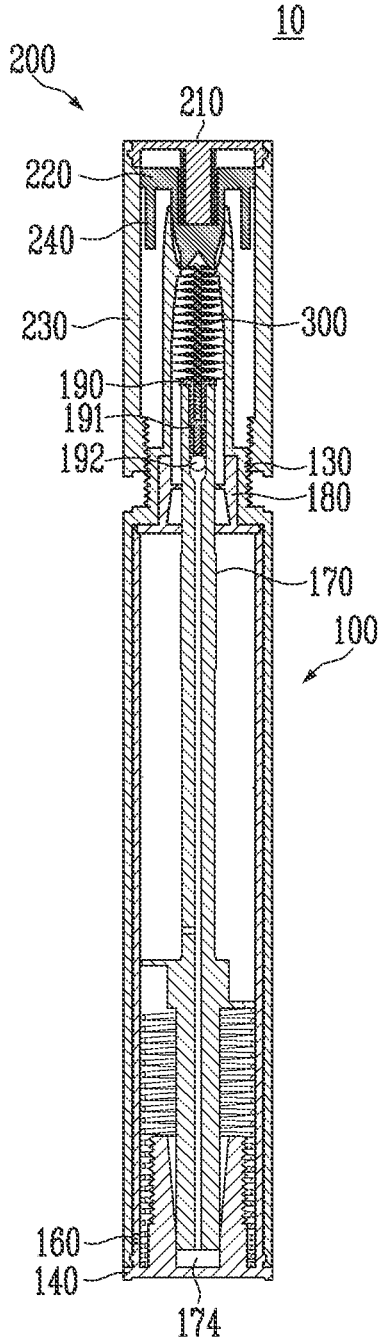
FIG. 4B is a cross-sectional diagram of a process of coupling a lid portion and a main body in a cosmetic case according to one embodiment of the present invention.
Figure 4C:
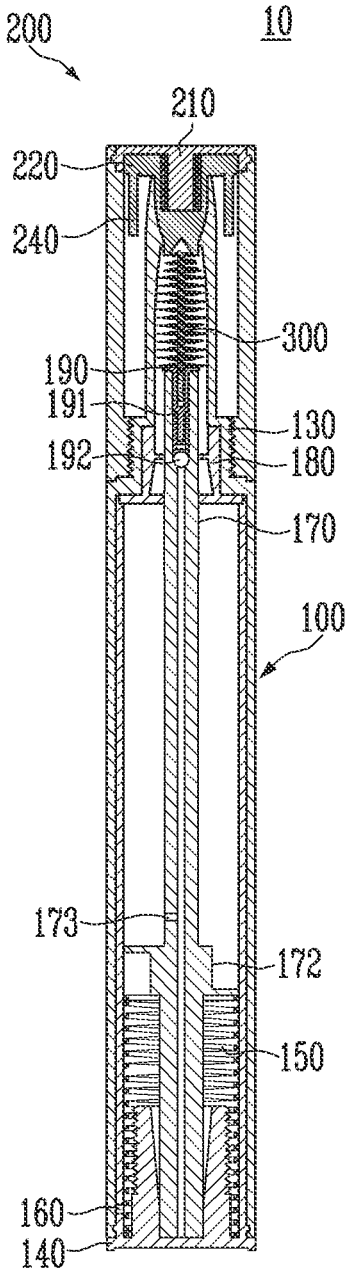
FIG. 4C is a cross-sectional diagram of a process of coupling a lid portion and a main body in a cosmetic case according to one embodiment of the present invention.
Figure 5A:
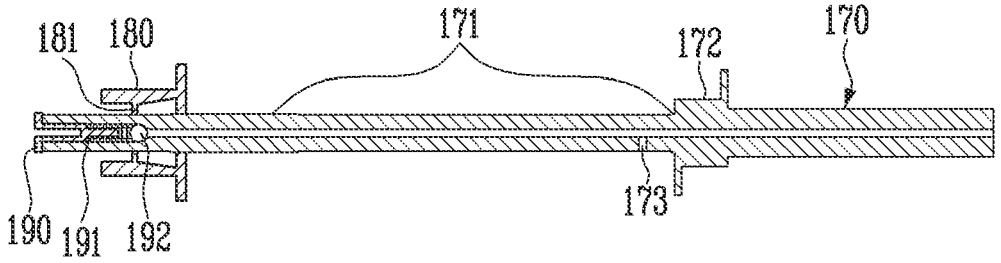
FIG. 5A is a cross-sectional diagram of a state of a support portion supporting a brush in a cosmetic case according to one embodiment of the present invention.
Figure 5B:
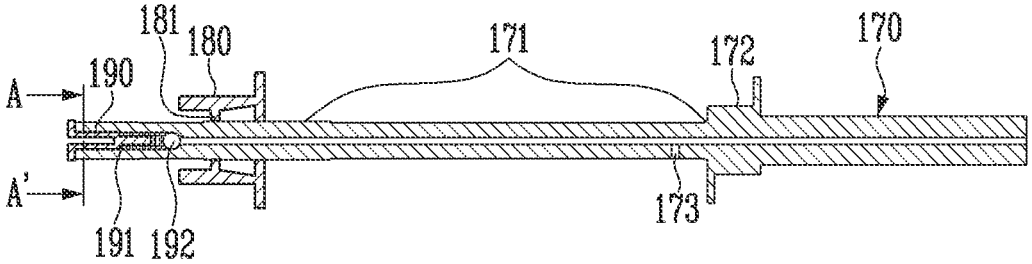
FIG. 5B is a cross-sectional diagram of a state of a support portion supporting a brush in a cosmetic case according to one embodiment of the present invention.
Figure 6:
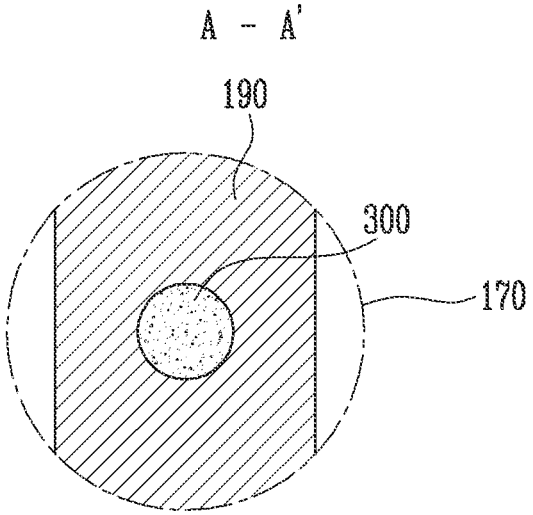
FIG. 6 is a vertical cross-sectional diagram of a support portion and a brush in a cosmetic case according to one embodiment of the present invention.

FIG. 3 is a cross-sectional diagram of a state of an application portion protruding from a cosmetic case according to one embodiment of the present invention; FIG. 4A is a cross-sectional diagram of a process of coupling a lid portion and a main body in a cosmetic case according to one embodiment of the present invention; FIG. 4B is a cross-sectional diagram of a process of coupling a lid portion and a main body in a cosmetic case according to one embodiment of the present invention; FIG. 4C is a cross-sectional diagram of a process of coupling a lid portion and a main body in a cosmetic case according to one embodiment of the present invention; FIG. 5A is a cross-sectional diagram of a state of a support portion supporting a brush in a cosmetic case according to one embodiment of the present invention; FIG. 5B is a cross-sectional diagram of a state of a support portion supporting a brush in a cosmetic case according to one embodiment of the present invention; and FIG. 6 is a vertical cross-sectional diagram of a support portion and a brush in a cosmetic case according to one embodiment of the present invention.

Referring to FIG. 3, a lid portion 200 and a main body 100 are separated so that an application portion 300 protrudes from a main body 100. When a lid portion 200 and a main body 100 are separated, a compressed first spring 150 is elongated to deliver an elastic force to a delivery portion 172 of a brush 170. A delivery portion 172 provided at a brush 170 receives an elastic force of a first spring 150 to enable a brush 170 to slide inside a guide portion 140, and a support portion 180 supports sliding of a brush 170 to prevent a cosmetic from leaking beyond a support portion 180.

A delivery portion 172 may slide together with a brush 170 and move a cosmetic included in a guide portion 140. In FIG. 2, a delivery portion 172 is disposed above a first spring 150, and in FIG. 3, a delivery portion 172 is raised and disposed below a support portion 180.

In a process of changing from FIG. 2 to FIG. 3, a delivery portion 172 and a brush 170 have slidingly ascended, and accordingly, a cosmetic provided above a delivery portion 172, that is, a cosmetic provided between a support portion 180 and a delivery portion 172, has ascended. However, since an accommodating space and a storage space are separated by a support portion 180, a cosmetic may not pass over a support portion 180 but may pass through a delivery portion 172 to move between a delivery portion 172 and a first spring 150.

A process of changing from FIG. 3 to FIG. 2 is that a delivery portion 172 and a brush 170 slidingly descend, and accordingly, a cosmetic provided below a delivery portion 172, that is, a cosmetic provided between a delivery portion 172 and a first spring 150 may descend and move to a compression space 174.

A delivery portion 172 provided at a brush 170 may move up or down a cosmetic according to sliding of a brush 170.

Referring to FIG. 3, at a brush 170 has moved a maximum movement distance, and movement of an expansion portion 171 provided on a delivery portion 172 or above a delivery portion 172 has been prevented by a support portion 180.

An expansion portion 171 provided above a delivery portion 172 engages with a support portion 180 to prevent leakage of a cosmetic stored in a storage space, and an accommodation space is also formed as a closed space by a brush 170 and a support portion 180 so that a cosmetic may not leak even when a user performs makeup by using a main body 100 as a handle.

The thickness of an expansion portion 171 in a brush 170 is provided to be thicker than a thickness of other sections, and thus a sliding speed of an expansion portion 171 supported by a support portion 180 may be changed by an expansion portion 171.

An expansion portion 171 may be provided above a delivery portion 172 in addition to a specific section and may have a function that is different from an expansion portion 171 provided in a specific section. An expansion portion 171 provided in a specific section of a brush 170 adjusts movement speed of a brush 170 to prevent a cosmetic from splashing as an application portion 300 quickly pops up when a cosmetic case 10 according to an embodiment of the present invention is opened and to give a user a luxurious feeling with a gradually rising effect.

An expansion portion 171 provided above a delivery portion 172 may have at least a same size as an expansion portion 171 provided in a specific section to be engaged with a support portion 180 at a maximum movement distance of a brush and thereby prevent leakage of a cosmetic stored in a storage space.

Referring to FIGS. 5A and 5B, a thickness of an expansion portion 171, which is a specific portion of a brush 17, is provided to be thicker than a thickness of other sections. Although an expansion portion 171 is illustrated to be distinguished from other sections by a step in a brush 170, but this is only an example, and a thickness may gradually change to form a linear shape.

Referring to FIG. 5A, a distance between a protruding point 181 protruding from a support portion 180 is equal to a thickness of a brush 170 so that a protruding point 181 from a support portion 180 is not bent. Referring to FIG. 5B, a protruding point 181 from a support portion 180 is bent to support an expansion portion 171 that is thick in a brush 170.

When a protruding point 181 from a support portion 180 is bent, a larger area comes into contact with a brush 170 so a sliding speed of a brush 170 may be reduced. Since a protruding point 181 from a support portion 180 is made of an elastic material, when another section of a brush 17 where a thickness becomes thin again is supported, a protruding point 181 from a support portion 180 again supports a brush 170 in an original shape, and a sliding speed of a brush 170 at that time may be faster than a speed at an expansion portion 171 that is thick.

Referring to FIG. 5A, a brush 170 has a constant thickness in a direction from one end at which an application portion is provided to the other end, becomes thick in a specific section, and then becomes constant again like an original thickness. A thickness of each section in a brush 170 may vary.

In a cosmetic case 10 according to an embodiment of the present invention, when a lid portion 200 and a main body 100 are separated, an application portion 300 protrudes from a second body 120 by a brush 170, and due to a thickness difference an expansion portion 171 and other sections in a brush 170, an application portion 300 may have an effect of gradually rising in a specific section where an expansion portion 171 is provided.

In other words, when a user separates a cap to use a cosmetic, an application portion 300 rises quickly before a specific section of a brush 170, slowly in a specific section, and quickly again after passing a specific section, and thus an effect of rising slowly in a specific section in the middle may be maximized to give a user a luxurious feeling.

In addition, when a first spring 150 is fully elongated after passing through a specific section, a sliding force of a brush 170 is weakened, and an application portion 300 may rise quickly before a specific section, slowly in a specific section due to a thickness, and slowly even after passing a specific section as an elastic force of a first spring 150 is consumed so that an application portion 300 may continue to rise slowly from a specific section.

In addition, even when a protruding point 181 of a support portion 180 is not provided to be bent, as described above, an application portion 300 may be configured to rise slowly in a specific section. When a diameter of a specific section where an expansion portion 171 is provided is provided to coincide with a diameter of a protruding point 181 of a support portion 180, a movement speed of a brush 170 may be faster in other sections where a thickness becomes thin so that a same effect described above may be exhibited.

Referring to FIGS. 4A, 4B and 4C, FIG. 4A shows a state in which a second body 120 and an application portion 300 are in contact with a movable lid 220 to couple a lid portion 200 and a main body 100; FIG. 4B shows a movable lid 220 has partially introduced an application portion 300 so that a lid portion 200 and a main body 100 are partially coupled; and FIG. 4C shows that a lid portion 200 and a main body 100 are completely coupled.

A protective sleeve 240 connected to a movable lid 220 is provided inside a second coupling portion 230 until a second body 120 or an application portion 300 comes into contact with a movable lid 220 to prevent penetration of a cosmetic.

Since a second body 120 and a protruding part from a movable lid 220 come into contact with each other, a cosmetic remaining in an application portion 300 may not move to a second coupling portion 230 and thus no cosmetic may reach a second coupling portion 230. Therefore, a hygiene and aesthetic problem may be solved, and a problem in coupling and separation due to hardening of a cosmetic remaining in an existing coupling portion may also be solved.

When a lid portion 200 and a main body 100 are coupled, a movable lid 220 may come into contact with an application portion 300 to apply a certain pressure to an application portion 300, and a constant pressure may compress a first spring 150 to provide a driving force for sliding of a brush 170 when a lid 200 and a main body 100 are separated.

Since a movable lid 220 comes into contact with an application portion 300, it is made of an elastic material to minimize damage to an application portion 300.

Existing cosmetic cases had a problem that a cosmetics may flow out of a case when a lid is opened or tilted while a lid is not completely coupled.

In contrast, in a cosmetic case 10 according to one embodiment of the present invention, when a lid 200 is opened or is not completely coupled, a second spring 250 provided on a lid portion 200 pushes away a main body 100 so that a user may confirm whether a lid is closed, and when a lid portion 200 and a main body 100 are only partially coupled, a movable lid 220 is in contact with a second body 120 so that a problem of cosmetic outflow may not occur.

Referring to FIG. 4A, FIG. 4A shows a state in which a movable lid 220 is in contact with a second body 120 and an application portion 300, which may be a state in which a compression space 174 is formed by a guide portion 140 and the other end of a brush 170 or a state in which a compression space 174 is partially compressed.

FIG. 4B shows a state in which a movable lid 220 partially introduced an application portion 300 so that a lid portion 200 and a main body 100 are partially coupled, and as a compression space 174 is provided to be smaller than in FIG. 4A, a cosmetic of a compression space 174 may be delivered to an accommodation space through an inside of a brush 170.

When a user uses a cosmetic, a cosmetic may be included in an application portion 300 within an accommodation limit, and an application portion may absorb a cosmetic within an accommodation limit in an accommodation space.

FIG. 4C shows a state in which a lid portion 200 and a main body 100 are completely coupled, and a movable lid 220 is in contact with a fixed cover 210, and the other end of a brush 170 is in contact with a guide portion 140 so that a compression space 174 has disappeared.

A cosmetic provided in a compression space 174 has all delivered to an accommodation space through an inside of a brush 170, and an application portion 300 in an accommodation space may have sufficiently absorbed a cosmetic within an accommodation limit.

However, in a processes between FIG. 4B and FIG. 4C, an application portion 300 in an accommodation space may have sufficiently absorbed a cosmetic within an accommodation limit, and in such a case, a cosmetic delivered to a compression space 174 may be recovered to a guide portion through a recovery port 173.

At least a part of a cosmetic flowing inside a brush 170 is recovered through a recovery port 173, and when an accommodation space is fully filled with a cosmetic, all of a cosmetic flowing inside a brush 170 may be recovered to a guide portion 140 through a recovery port 173.

An amount of cosmetic used through an application portion 300 may be different among users. When a user finishes makeup and couples a lid portion 200 and a main body 100, a cosmetic case 10 according to one embodiment of the present invention may automatically supply a sufficient amount of cosmetic from an accommodation space to an application portion 300 through a compression space 174 and an inside of a brush so that an application portion 300 may supply a certain amount of cosmetic when a user later uses again.

Referring to FIGS. 4A, 4B and 4C, a lower end of a connection portion 190 protrudes, and a third spring 191 is provided at the protruding lower end. A third spring 191 is connected to a sealing portion 192 that seals an inside a brush 170 so that a connection portion may be provided at one end of a third spring 191 and a sealing portion 192 may be provided at the other end.

A sealing portion 192 may be a device that allows a cosmetic inside a brush 170 to move toward an accommodation space, but prevents movement in a reverse direction from an accommodation space to an inside of a brush 170. A sealing portion 192 may have various shapes, such as beads and stoppers and may distinguish a brush 170 and an accommodation space.

A third spring 191 may allow a sealing portion 192 to move up and down, and when a cosmetic provided in a compression space 174 moves to an accommodation space through an inside of a brush 170, it may compress to raise a sealing portion 192 by pressure of a cosmetic. For a third spring 191 provided at a lower end of a connection portion 190 to compress, a length of a protruding part at a lower end of a connecting portion 190 may be provided to be shorter than a length of a third spring 191.

On the other hand, when a cosmetic moves from an accommodation space to an inside of a brush 170, a sealing portion 192 seals an inside of a brush 170 in a state in which a third spring 191 is elongated to prevent an inflow of external air, thereby helping a cosmetic to maintain a vacuum state. FIG. 4A shows a case in which a cosmetic is not delivered to an accommodation space, which is a situation where a third spring 191 is elongated and a sealing portion 192 has sealed an inside of a brush 170.

FIG. 4B shows a situation where a cosmetic provided in a compression space 174 is delivered to an accommodation space along an inside of a brush 170 and a third spring 191 is compressed and a sealing portion 192 rises so that a cosmetic may move to an accommodation space.

In FIG. 4C, because an accommodation space is fully filled with a cosmetic and thus no more cosmetic may move, a third spring 191 has been elongated and a sealing portion 192 has not risen.

Referring to FIG. 5B, A-A' that vertically intersects a brush 170 and a connecting portion 190 is displayed, and a cross-section thereof is illustrated in FIG. 6.

FIG. 6 shows a brush 170 of which inside is empty in a form of a hollow tube and a cross-section of a connection portion 190 connected to one end of a brush 170.

A cross-section of a connection portion 190 may have a partially open shape compared to a cross-section of a brush 170 or a shape that is smaller than a cross-section of a brush 170 so that a cosmetic provided inside a brush 170 may be delivered to a connection portion 190.

For example, when a user separates a lid portion 200 and a main body 100 and uses an application portion 300 to consume a cosmetic on an application portion 300, an application portion 300 may absorb a cosmetic filled in a brush 170 so that a user may continue to perform makeup.

In a case where a cosmetic filled in an inside of a brush 170 is consumed, when a brush 170 is compressed by pressing a main body 100 with a lid portion 200, a cosmetic provided in a compression space 174 moves to an inside of a brush 170 so that makeup may be continuously performed.

Pressing a main body 100 with a lid portion 200 is applying pressure to an application portion 300 with a movable lid 220, and a delivery portion 172 of a brush 170 applies pressure to a cosmetic provided between a delivery portion 172 of a brush 170 and a first spring 150 to move a cosmetic in a compression space 174 to an empty inside of a brush 170. A cosmetic moved to an inside of a brush 170 may supply a cosmetic to a connection portion 190 due to a cross-sectional difference between a connection portion 190 and the a brush 170 so that an application portion 300 may absorb a cosmetic again.

Figure 7:
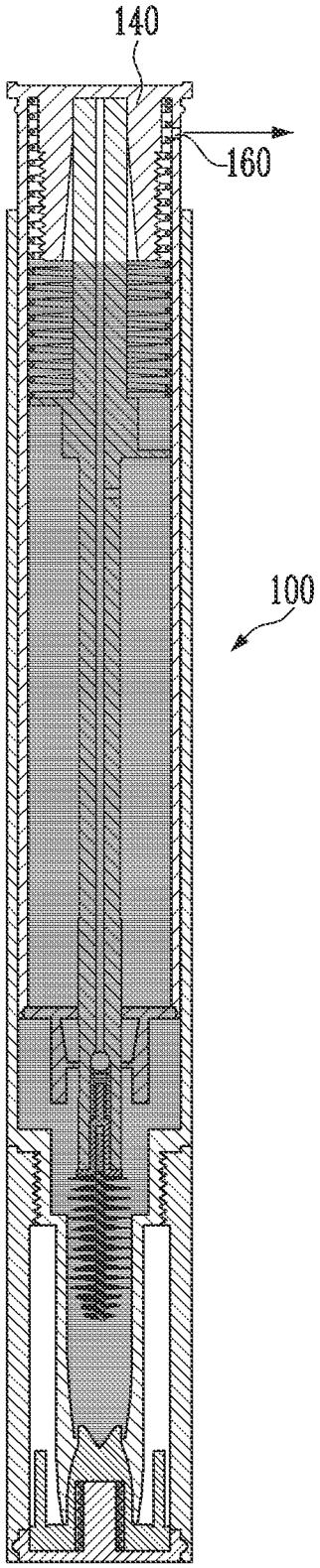
FIG. 7 is a cross-sectional diagram of a process of coupling a main body and a guide portion in a cosmetic case according to one embodiment of the present invention.
Figure 8A:
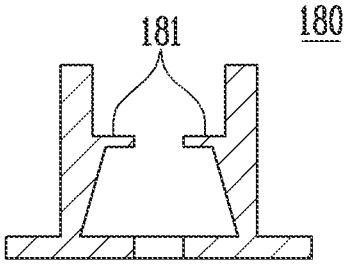
FIG. 8A is a diagram of a support portion in a cosmetic case according to one embodiment of the present invention.
Figure 8B:
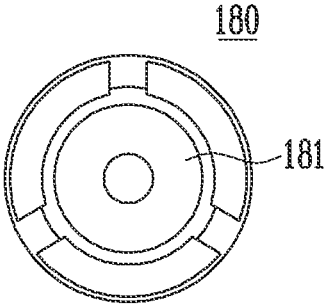
FIG. 8B is a diagram of a support portion in a cosmetic case according to one embodiment of the present invention.
Figure 8C:
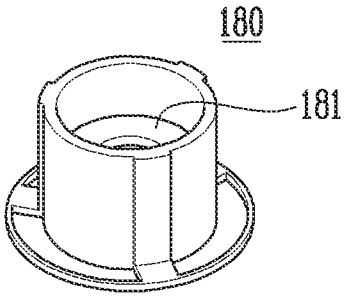
FIG. 8C is a diagram of a support portion in a cosmetic case according to one embodiment of the present invention.

FIG. 7 is a cross-sectional diagram of a process of coupling a main body and a guide portion in a cosmetic case according to one embodiment of the present invention; and FIGS. 8A, 8B and 8C are diagrams of a support portion in a cosmetic case according to one embodiment of the present invention. Referring to FIGS. 8A, 8B and 8C, FIG. 8A is a side view of a support portion 180; FIG. 8B is a front view of a support portion 180, and FIG. 8C is a perspective view of a support portion 180.

As described above, a support portion 180 may comprise a protruding point 181 and a surface forming an accommodation space. Referring to FIG. 8B, a protruding point 181 may represent a smallest circle in a support portion 180, and a surface forming an accommodation space may represent a surface formed at a bottom in a partially perforated shape.

A Cosmetics may move through a surface forming an accommodation space in a support portion 180. A perforated shape of a surface forming an accommodation space in a support portion 180 is obstructed by a main body when a main body 100 and a guide portion 140 are coupled in a state where a cosmetic is stored in FIG. 7.

When a main body 100 and a guide portion 140 are coupled, a cosmetic may move through a support portion 180, and after coupling, a cosmetic may not move through a support portion 180, and a support portion 180 may distinguished an accommodation space for accommodating an application portion 300 and a storage space for storing a cosmetic.

Referring to FIG. 7, a guide portion 140 and a brush 170 are coupled to a main body 100 in which a cosmetic is stored. In a state in which a main body 100 and a lid portion 200 are coupled, a movable lid 220 of a lid portion 200 is in contact with a second body 120 to form an accommodation space with one side sealed, and specifically, a cosmetic may be filled inside a first body 110 in an accommodation space with one side sealed.

A first spring 150, a brush 170, a support portion 180, and air may be provided inside a guide portion 140.

When a guide portion 140 is provided as a closed space, air provided in a guide portion 140 may not escape. Therefore, when a guide portion 140 is assembled to a main body 100 in which a cosmetic is stored, as pressure inside a guide portion 140 is increased, a lot of force is required for assembly, and a cosmetic stored in a main body 100 may overflow.

In a cosmetic case 10 according to one embodiment of the present invention, a discharge portion 160 is provided in a guide portion 140 to allow air provided in a guide portion 140 to escape. Referring to FIG. 7, a guide portion 140 containing air is pressed to assemble into a main body 100 where a cosmetic is stored. As air contained in a guide portion 140 is discharged through a discharge portion 160, assembly may be easily performed.

Since air contained in a guide portion 140 is discharged through a discharge portion 160 so that a guide portion 140 is provided in a vacuum state, and a discharge portion 160 is blocked from an outside by a main body 100, there is no worry that a cosmetic included in a guide portion 140 may deteriorate due to air.

A surface forming an accommodation space in a support portion 180 allows a cosmetic to move inside a guide portion 140 when a guide portion 140 and a main body 100 are assembled, and a discharge portion 160 is to discharge air provided inside a guide portion 140 when a guide portion 140 and a main body 100 are assembled. After a guide portion 140 and a main body 100 are completely assembled, a surface forming an accommodation space in a support portion 180 and a discharge portion 160 may be blocked by a main body 100 so that a cosmetic may not leak.

Figure 9:
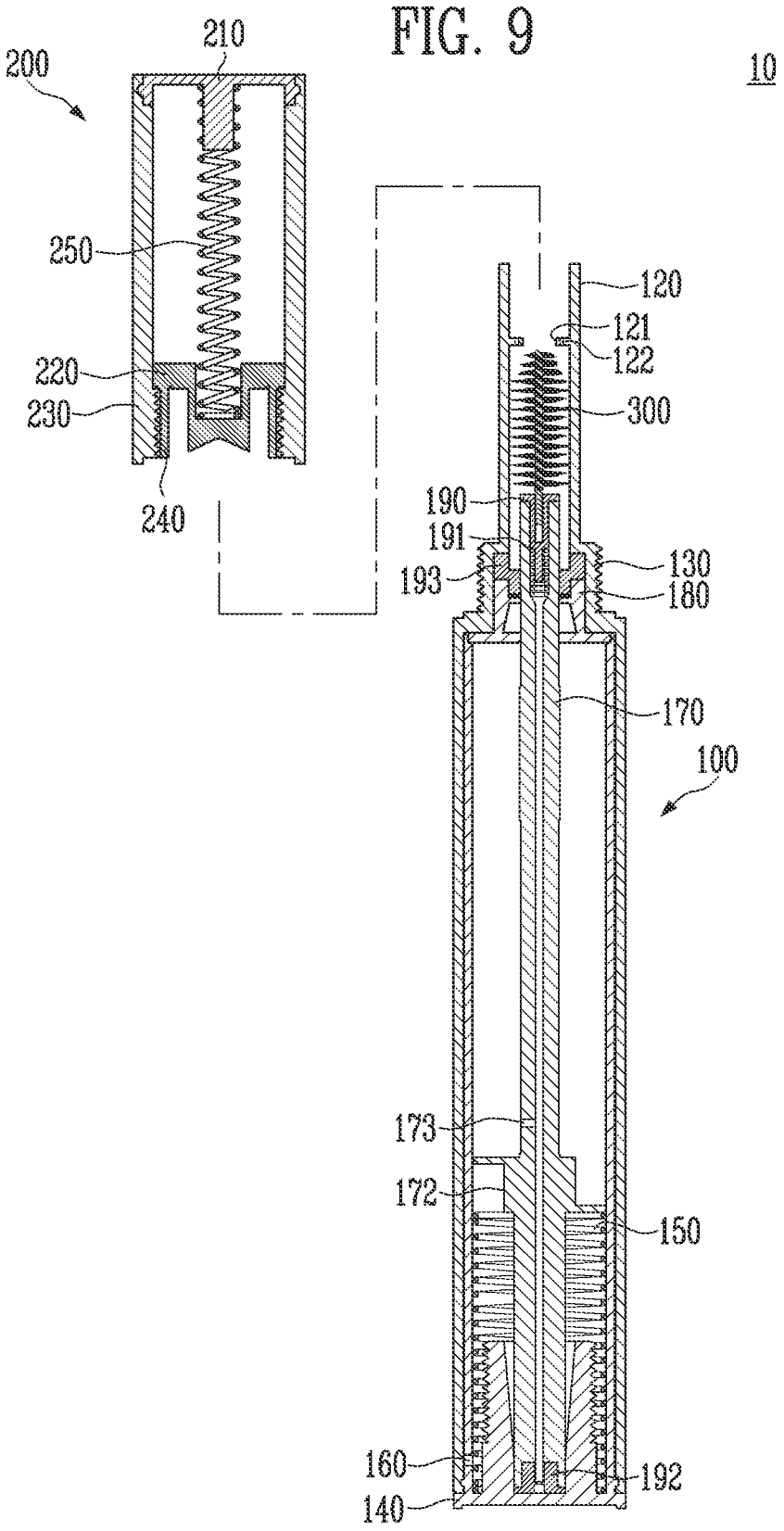
FIG. 9 is a diagram of a cosmetic case according to another embodiment of the present invention.

FIG. 9 is a diagram of a cosmetic case according to another embodiment of the present invention, in which some features may be different from a cosmetic case according to one embodiment of the present invention described above.

A part of a movable lid 220 that comes into contact with an application portion 300 may be provided in a shape in which a central part is concave and a periphery is protruding so as to cover a part of an application portion 300. A central part of an area in contact with an application portion 300 may be formed as a wider area and have a gentle slope so that an application portion 300 may easily come into contact with a movable lid 220.

Through dual sealing in which a movable lid 220 comes into contact with a second body 120 to seal and a shape protruding from a movable lid 220 comes into contact with an application portion 300 to seal, a cosmetic may be prevented from leaking out of an accommodation space in which an application portion 300 is accommodated.

A movable lid 220 and a second body 120 are in contact with each other in a vertical form or face to face so that a movable lid 220 may vertically come into contact with a filter portion 121 protruding inward from a second body 120.

A filter portion 121 may protrude to an inside of a second body 120 and may be provided in a donut shape with an open central part. A donut shape comprises a plurality of filter holes 122 to filter a certain amount of cosmetic through filter holes 122.

An application portion 300 and a brush 170 penetrate a central part of a filter portion 121, and when an application portion 300 and a brush 170 penetrate, a cosmetic may be pushed away to be provided on filter holes 122. Filter holes 122 may filter a certain amount of cosmetic per unit time into an inside of a first body 110.

In the process where a user uses a cosmetic through an application portion 300 and then finishes using a cosmetic case 10 by bringing a lid portion 200 and a main body 100 into a close contact, an application portion 300 protruding from a second body 120 comes into contact with a movable lid 220 to be introduced to an inside of a main body.

A cosmetic remaining after use by a user may remain in an application portion 300, and a part of remaining cosmetic may be filtered out by a filter portion 121 in a process where an application portion 300 is introduced to a main body 100.

Of a cosmetic remaining around an application portion 300, a cosmetic filtered by a filter portion 121 may move into an inside of a first body 110 through a plurality of filter holes 122, and a moving amount and a moving speed of a cosmetic may vary according to the number of filter holes 122 formed on a filter portion 121.

When a user separates a lid portion 200 from a main body 100 to use a cosmetic, a process in which an application portion 300 and a brush 170 protrude through a central part of a filter portion 121 is carried out, and an application portion 300 may protrude while absorbing a part of cosmetic remaining in a filter portion 121.

When filter holes 122 are not provided in a filter portion 121, a problem may occur that a filtered cosmetic still remains in a filter portion 121, and an application portion 300 absorbs a remaining cosmetic while protruding so that a cosmetic in an amount more than required may be distributed to an application portion 300, but the problem may be prevented as filter holes 122 are provided on a filter portion 121.

Referring to FIG. 9, a sealing portion 192 is disposed at a tip of a brush 170 so that an amount of cosmetic, provided in a compression space 174, moving to an inside of a brush 170 may be controlled, and it may be disposed farther than a recovery port 173 with reference to an application portion 300.

A sealing portion 192 may be provided in a cylindrical shape and may be coupled with a brush 170. An end part may be provided to have a same cross-sectional area as a brush 170, and a part that protrudes from an end and that is introduced to brush 170 may be provided to have a smaller cross-sectional area than that of a brush 170 so that an end part of a sealing portion 192 may cover an tip of a brush 170.

A sealing portion 192 is made of an elastic material like rubber, such that it is easily introduced to a brush but is not easily separated by movement of a brush 170, and so it may be made of a material that is different from a brush 170 but is not limited thereto.

A connection portion 190 is provided at one end of a brush to be connected to an application portion 300, and a sealing portion 192 is provided at the other end or a tip to control an amount of cosmetic introduced from a compression space 174 to an inside of a brush 170. A central part of a sealing portion 192 is provided to allow a cosmetic to move in only one direction so that a cosmetic may move into an inside of a brush 170 through a sealing portion 192, but a cosmetic may be prevented from being discharged from an inside of a brush 170 and one direction may vary according to a shape of a central part of a sealing portion 192.

A central part of a sealing portion 192 is made of an elastic material, and an opening is normally closed by contacting each other. However, when a cosmetic applies pressure from a lower end of a central part of a sealing portion 192, an opening is gaped and a cosmetic so that a cosmetic may move into an inside of a brush 170. When a cosmetic applies pressure from a upper end of a central part of a sealing portion 192 in an opposite direction, contact of an opening may become firm to prevent movement of a cosmetic.

A sealing portion 192 is a device that allows a cosmetic to move in only one direction, either to an inside or outside of a brush 170, and may help a brush 170 keep a certain amount of cosmetic.

Referring to FIG. 9, an arrangement portion 193 may be provided between a filter portion 121 and a support portion 180. An arrangement portion 193 may be provided in a shape with an open central part on an application portion 300 and a brush 170, and may be fixed at a position or move within a certain section.

When a user finishes using a cosmetic, a lid portion 200 and a main body 100 are brought into close contact so that an application portion 300 protruding from a second body 120 may be in contact with a movable lid 220 to be introduced to an inside a main body 100.

At this time, a cosmetic left after being used by a user may remain in an application portion 300, and as described above, a filter portion 121 may primarily filter a cosmetic and an arrangement portion 193 may secondarily arrange a cosmetic.

An arrangement portion 193 comprises in a central part an opening that is smaller than an outer diameter of an application portion 300, and a part of an application portion 300 that is positioned outside an opening of an arrangement portion 193 may temporarily undergo folding or bending an arrangement portion 193.

An arrangement portion 193 may arrange a cosmetic provided an application portion 300 during a process in which an application portion 300 protrudes from or is introduced to a first body 110 so that a uniform amount of cosmetic may be applied to an application portion 300.

When an application portion 300 protrudes from a first body 110, an arrangement portion 193 may be disposed to be in contact with a first coupling portion 130 so that an application portion 300 may provide a user with a uniform amount of cosmetic while passing through an arrangement portion 193 and a filter portion 121.

When an application portion 300 is introduced to a first body 110, an application portion 300 may primarily arrange a cosmetic by a filter portion 121, and a cosmetic may be secondarily arranged by an arrangement portion 193 provided between a filter portion 121 and a support portion 180.

An arrangement portion 193 may be provided in multiple stages and may be provided to have a larger diameter at an upper end than at a lower end so that a cosmetic arranged at an opening at a lower end may be temporarily stored within an upper end. An upper end is provided to be in contact with a first coupling portion 130, and a lower end is provided to be in contact with a support portion 180 to prevent an unused cosmetic provided in a main body 100 from contacting with external air and a cosmetic exposed to external air.

In addition, a sealing ring may be provided between an arrangement portion 193 and a support portion 180 to block an inflow of external air dually by a sealing ring and a support portion 180 so that a content or a cosmetic may be sealed to keep a vacuum state. Additionally, an arrangement portion 193 may be provided at an upper end of a sealing ring to reinforce sealing.

What is expressed as mascara above is only an example of how a cosmetic case according to the present invention may be used, and is not limited thereto.

The structural or functional descriptions of Examples disclosed in the present specification or application are merely illustrated for the purpose of explaining Examples according to the technical principle of the present invention, and Examples according to the technical principle of the present invention may be implemented in various forms in addition to the Examples disclosed in the specification of application. In addition, the technical principle of the present invention is not construed as being limited to the Examples described in the present specification or application.

As described above, disclosed embodiments have been described with reference to attached drawings. Those skilled in the art to which the present invention pertains will understand that the present invention may be practiced in forms different from the disclosed embodiments without changing the technical principles or essential features of the present invention. The disclosed embodiments are illustrative and should not be construed as limiting.

What is claimed is:

1. A cosmetic case comprising:

an application portion for delivering a cosmetic to a place of use;

a main body having an accommodation space for accommodating the application portion and a storage space for storing a cosmetic;

a guide portion provided inside the main body to form a double tube with the main body to form the storage space;

a brush having one end fixed to the application portion and another end provided to be movable within the guide portion;

and a lid portion for sealing an outside of the accommodation space and introducing the application portion to the accommodation space, wherein the guide portion provides a compression space storing a cosmetic on one side facing the brush and compressing the cosmetic by the another end of the brush, and wherein the brush has a hollow tube shape and is provided with a discharge port at one end toward the application portion and with a recovery port toward inside of the guide portion.

2. The cosmetic case according to claim 1, wherein, when the application portion is introduced by the lid portion, as the compression space is compressed by the brush, a cosmetic positioned in the compression space is delivered to the accommodation space along an inside of the brush, and at least a part of a cosmetic flowing inside the brush is received to the guide portion through the recovery port.

3. The cosmetic case according to claim 2, further comprising:

a delivery portion for delivering a force of a first spring provided on a lower surface of the guide portion to enable movement of the brush;

a support portion for supporting the brush to form the accommodation space;

a connection portion for connecting the application portion and the brush;

a sealing portion for sealing an inside of the brush; and a second spring provided between the connection portion and the sealing portion, wherein the sealing portion, when a cosmetic is delivered from an inside of the brush to the accommodation space, contacts with the connection portion by compression of the second spring to enable delivery of a cosmetic and blocks delivery of a cosmetic in direction from the accommodation space to an inside of the brush.

4. The cosmetic case according to claim 3, wherein the lid portion surrounds a part of the application portion to limit movement of the application portion, and the application portion absorbs within an acceptable limit a cosmetic delivered to the accommodation space according to compression of the compression space so that a cosmetic is delivered within the acceptable limit regardless of an amount of cosmetic used by a user.

5. A cosmetic case comprising:

an application portion for delivering a cosmetic to a place of use;

a main body having an accommodation space for accommodating the application portion and a storage space for storing a cosmetic;

a guide portion provided inside the main body to form the storage space;

a brush having one end fixed to the application portion and another end provided to be movable within the guide portion;

a support portion for supporting the brush and distinguishing the accommodation space and the storage space; and an expansion portion in which thickness of a specific section of the brush becomes thicker, wherein a movement speed when the expansion portion passes the support portion is slower than a movement speed when another section of the brush passes the support portion.

6. The cosmetic case according to claim 5, wherein the expansion portion is provided, in addition to the specific section, above a delivery portion for delivering a force of a first spring provided on the guide portion to enable movement of the brush, wherein the expansion portion provided above the delivery portion is engaged with the support portion at a maximum movement distance of the brush to prevent leakage of a cosmetic stored in the storage space.

7. A cosmetic case comprising:

a main body comprising a first body, a second body, and a first coupling portion;

an application portion for using a cosmetic stored in the main body; and a lid portion coupled to the first coupling portion, the lid portion comprising: a movable lid contacting with the application portion to move inside the lid portion;

a fixed lid fixed to one end of the lid portion;

a second coupling portion coupled to the first coupling portion; and a protective sleeve provided inside the second coupling portion to move together with the movable lid, wherein in coupling of the lid portion and the main body, the movable lid contacts with the second body and the application portion to move in a direction where the fixed lid is prepared, and the protective sleeve which moves together with the movable lid eventually exposes the second coupling portion so that the second coupling portion and the first coupling portion are coupled to fix.

8. The cosmetic case according to claim 7, wherein the protective sleeve protects the second coupling portion so that a cosmetic discharged through the application portion does not reach the second coupling portion, and the movable lid is moved by a first spring provided on the fixed lid, and when no pressure is applied to the first spring, the movable lid is disposed immediately at a position where the second coupling portion is provided so that the protective sleeve may protect the second coupling portion.

9. The cosmetic case according to claim 8, comprising:

a guide portion engaged in an inside of the first body to form a double tube and be fixed;

a brush having one end at which the application portion is provided and another end engaged with the guide portion to form a compression space and slide; and a support portion provided inside the first coupling portion to support the brush, wherein the brush has a specific section in a longitudinal direction that is provided to be thicker than a thickness of other sections, and when the main body and the lid portion are separated, a sliding speed of the brush is different according to a thickness of the specific section so that a speed of the application portion protruding from the second body is different.

10. The cosmetic case according to claim 9, wherein the support portion is made of an elastic material to support the brush despite a thickness difference of the brush, and the brush comprises: a delivery portion that is distinguished by a step from other sections in the specific section or has a thickness that gradually changes to form a linear shape and that is provided in a direction perpendicular to the longitudinal direction, wherein the delivery portion is engaged with the guide portion to support sliding of the brush and limit a sliding length of the brush, enables the cosmetic to move within the guide portion in a dislocated shape, and delivers an elastic force of a second spring provided on the guide portion to the brush.

11. The cosmetic case according to claim 10, comprising a connection portion for connecting the application portion and the brush, wherein the connection portion is partially open in comparison with a cross-section in a direction perpendicular to the longitudinal direction of the brush to deliver the cosmetic provided in the brush, and the brush is introduced when the main body and the lid portion are coupled to enable a cosmetic provided in the compression space to move into the brush.

12. The cosmetic case according to claim 11, further comprising: a sealing portion for sealing an inside of the brush; and a third spring provided between the connection portion and the sealing portion, wherein the sealing portion, when a cosmetic is delivered from an inside of the brush to an accommodation space accommodating the application portion, contacts with the connection portion by compression of the third spring to enable delivery of a cosmetic and blocks delivery of a cosmetic in a direction from the accommodation space to an inside of the brush.

13. The cosmetic case according to claim 12, further comprising a discharge portion, which, when the main body and the guide portion are assembled, discharges air filled inside the guide portion so that the cosmetic stored in the main body passes through the support portion to move to the guide portion.

* * * * *